US008042650B1

(12) United States Patent
Becherer

(10) Patent No.: US 8,042,650 B1
(45) Date of Patent: Oct. 25, 2011

(54) PORTABLE TREE CLIMBING DEVICE

(76) Inventor: Mike Becherer, St. Peters, MO (US)

( * ) Notice: Subject to any disclaimer, the term of this patent is extended or adjusted under 35 U.S.C. 154(b) by 720 days.

(21) Appl. No.: 12/105,882

(22) Filed: Apr. 18, 2008

(51) Int. Cl.
*E06C 9/00* (2006.01)

(52) U.S. Cl. ..... 182/92

(58) Field of Classification Search ..... 182/90, 182/92

See application file for complete search history.

(56) References Cited

U.S. PATENT DOCUMENTS

| | | | | |
|---|---|---|---|---|
| 471,626 | A * | 3/1892 | Streeter | 182/90 |
| 2,461,825 | A * | 2/1949 | Kowalski | 248/210 |
| 5,080,193 | A * | 1/1992 | Woof | 182/116 |
| 5,704,448 | A * | 1/1998 | Jenkins, Jr. | 182/93 |
| 2005/0109559 | A1 * | 5/2005 | Eike | 182/90 |

* cited by examiner

*Primary Examiner* — Alvin Chin Shue

(74) *Attorney, Agent, or Firm* — Stinson Morrison Hecker LLP; Mark C. Young

(57) ABSTRACT

A removable step used to climb a vertical surface. The step has first and second structural members and at least two brace members spacing the structural members. A coupler is rigid with one of the structural members and is operable to secure the structural member to the vertical surface.

7 Claims, 2 Drawing Sheets

PORTABLE TREE CLIMBING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates to removable steps which are attached to a vertical surface such as a tree or a utility pole. The steps may be used both as manual climbing aids and as safety equipment attachment points.

2. Description of Related Art

In hunting, it is desirable to have means to facilitate climbing a tree. Various devices have been known in the prior art, and generally consist of some small step arrangement which is screwed to or otherwise attached to the tree. However, this type of device is difficult to use and sometimes dangerous.

The problem with the prior art devices is that the steps available do not provide a secure, safe step for hunters to use to climb the tree. Often times, a hunter's boots are damp and covered with mud and/or snow which makes the bottom of their boots slippery. Under such circumstances, it is difficult and dangerous to climb a tree using the tree step described in U.S. Pat. No. 4,775,030 to Wright. The small, narrow, round surface does not provide a stable place to step; especially, when the bottom of a hunter's boot is covered in mud. Also, the curved outer end of the step disclosed in U.S. Pat. No. 7,134,524 to Sprague presents a hazard if a user falls.

Furthermore, the steps disclosed in U.S. Pat. No. 3,298,459 to Bergsten, U.S. Pat. No. 6,439,343 to Jorges et al., and U.S. Pat. No. 4,700,807 to Kubiak all require the steps to be vertically staggered at obtuse angles from each other. This type of configuration limits the size of tree on which the steps can be comfortably and safely used.

The present invention overcomes the shortcomings of the prior art by providing a more secure structure for one to put a shoe or hand on to safely climb a vertical surface.

BRIEF SUMMARY OF THE INVENTION

The primary object of the present invention is to provide an apparatus for safely climbing a vertical surface. Another object of the present invention is to provide an apparatus that is more stable than the prior art devices discussed above. Additionally, the present invention provides structure to attach safety equipment. The present invention overcomes the shortcomings of the prior art and provides more stability and safety for a climber.

The present invention comprises a removable tree step apparatus for use in climbing a vertical surface. The removable tree step of the present invention comprises first and second structural members, at least two rigid brace members which hold the structural members in spaced apart relationship, and a coupler rigid with one of the structural members for securing the structural member to the vertical surface.

The removable tree step of the present invention allows the climber to place a shoe inside the first and second structural members. This design provides a more stable place for a climber's muddy shoe than the steps disclosed in the prior art discussed above. The present invention reduces the chances of the climber slipping off the step and provides an easier way to climb a tree.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
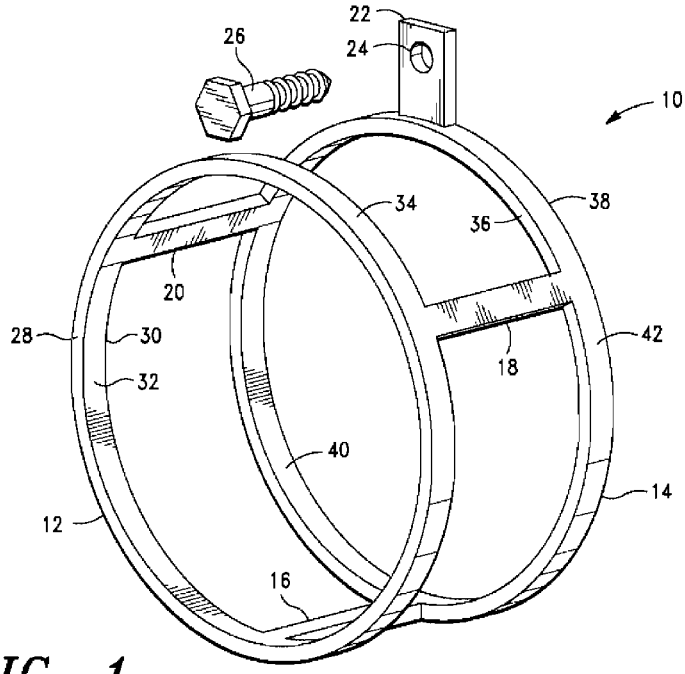
FIG. 1 is a perspective view of a tree step according to the present invention.
Figure 3:
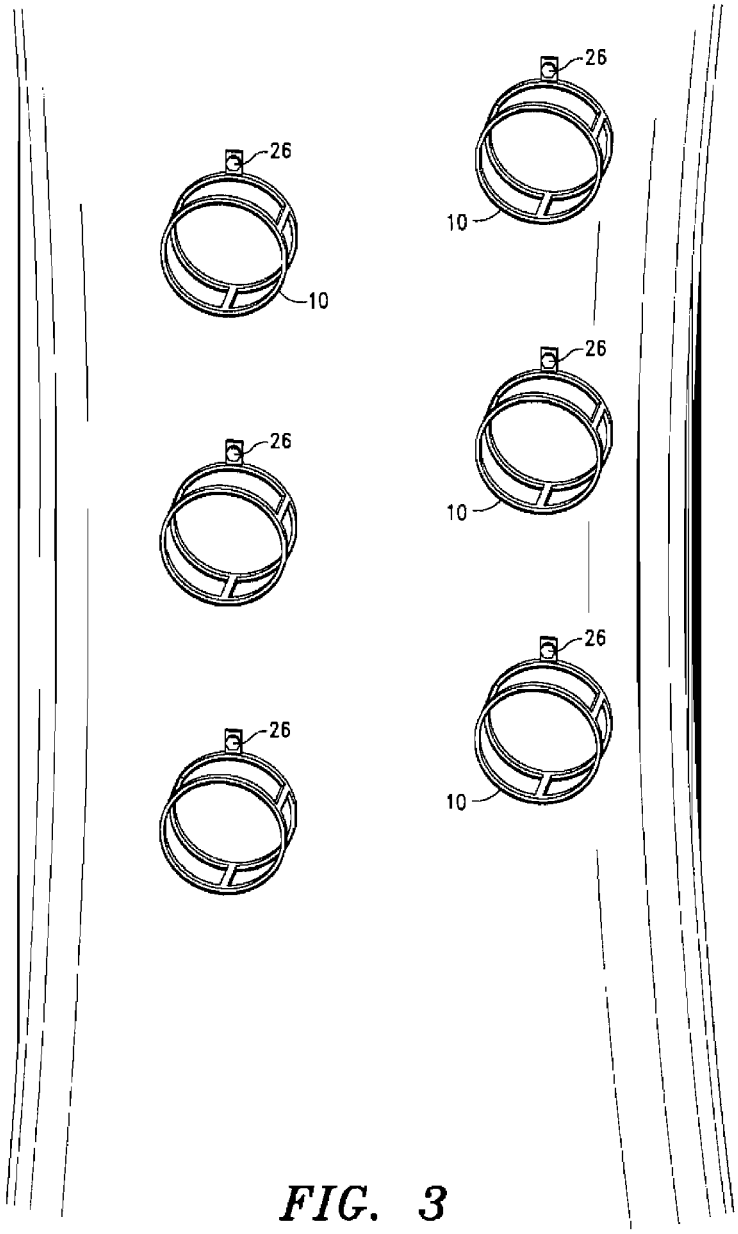
FIG. 3 is a perspective view showing a plurality of the steps of FIG. 1 coupled to a tree.

As shown in FIGS. 1 and 3, the present invention comprises a removable tree step 10 for use in climbing a tree. The novel tree step comprises first and second structural members 12 and 14, three rigid brace members 16, 18, and 20 which hold the structural members in spaced apart relationship, and a coupler 22 joined with structural member 14 for securing the structural member 14 to the tree. Although the step 10 is shown as being used for climbing a tree, the step of the present invention may be used for climbing any vertical surface.

Figure 2:
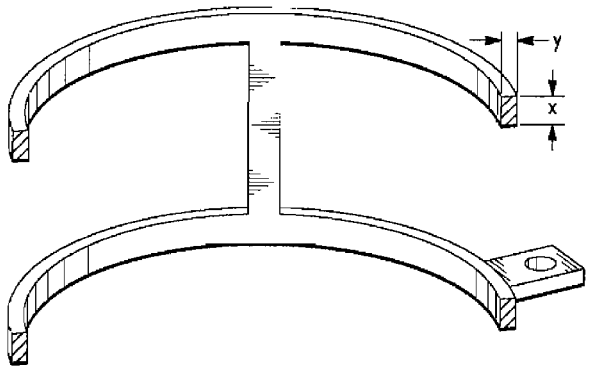
FIG. 2 is a cross-sectional view of the tree step of FIG. 1.

The removable tree step 10 shown in FIG. 1 is preferably made of rigid steel. Tree step 10 has first and second generally circular structural members 12 and 14. The circular structural members 12 and 14 have substantially the same diameter. The preferred diameter of the circular structural members is about 166 mm. Each structural member 12 and 14 preferably has a rectangular cross-section with a width x, as shown in FIG. 2, that is preferably about 13 mm and a thickness y that is preferably about 6.5 mm. First structural member 12 has a front surface 28, a rear surface 30, an inner surface 32 and an outer surface 34. Likewise, second structural member 14 has a front surface 36, a rear surface 38, an inner surface 40 and an outer surface 42.

The structural members 12 and 14 are supported by three rigid brace members 16, 18 and 20. The brace members 16, 18 and 20 are preferably made from the same material as the structural members 12 and 14 and have the same thickness as the structural members. Each rigid brace member 16, 18, and 20 is substantially the same length. The brace members hold the first and second structural members in spaced apart relationship. The brace members 16, 18 and 20 extend from the rear of structural member 12 to the front of structural member 14 to rigidly join the two members. Preferably, at least three brace members are spaced around the circumference of the first and second structural members 12 and 14. The brace members 16, 18 and 20 are positioned around the circumference of the structural members 12 and 14 in 120° degree intervals from each other. Furthermore, at least one brace member 16 is positioned at the bottom of the structural members 12 and 14 in order to provide rigid support for the climber's shoe. The brace members 16, 18 and 20 are preferably about 115 mm in length and about 13 mm in width.

The bottom brace member 16 is preferably positioned about 180° degrees from coupler 22. The coupler 22 is joined with and extends from the top of structural member 14. Coupler 22 comprises a tab with an opening 24 for receiving a fastening device 26. The preferred fastening device is a threaded lag bolt. The preferred lag bolt is ⅜ inch in diameter, or about 9.5 mm, and 4 inches in length, or about 102 mm. The opening 24 of the coupler 22 which receives the lag bolt 26 is smaller in diameter than the head of the lag bolt 26, but is large enough to receive the threaded shaft of the lag bolt 26. The coupler 22 of FIG. 1 extends upward from rear surface 38 of second structural member 14 and contacts the vertical surface while in use.

At least a portion of the tree step 10 is coated with a textured surface to increase safety and support. The textured surface preferably comprises rubber and/or polyurethane. The textured surface can be sprayed on or applied by dipping the tree step 10 in a substance that provides a synthetic cover. One possible material that may be used as a textured surface for the tree step is a synthetic rubber coating sold under the trade name Plasti Dip by Plasti Dip International, a company located in Blaine, Minn.

At least a portion of the first structural member 12 may be coated with a fluorescent material in order to increase visibility during darkness. This fluorescent material may be paint or a type of rubber covering. For example, when hunting before sunrise or sunset in the autumn, steps to a deer blind are more easily and safely traversed if they provide a fluorescent glow to the climber. Preferably, the top portion of the first structural member 12 is coated with the fluorescent material in order to assist the climber while descending the tree.

As shown in FIG. 3, to use the invention a multitude of steps 10 are preferably arranged less than 24 inches, or 609 mm, apart in a staggered order by fastening the steps securely to a tree. The steps 10 are fastened to the tree by lag bolts 26. The lag bolts 26 are placed through the opening 24 of the coupler 22 (shown in FIG. 1) and threaded into the tree. The shoe of the climber is placed inside the circular members 12 and 14 while ascending and descending the tree. The structural members 12 and 14 surround the climber's shoe and prevent the climber's shoe from sliding off the tree step. The climber can also grasp the first circular member 12 with a hand while ascending and descending the tree. The tree step 10 of the present invention provides a more secure place for the climber to grasp than conventional tree steps. The climber continues this motion until the desired position on the tree is reached. If the climber is using any type of safety harness or equipment, such as a carabiner, the safety equipment or harness can be attached to the structural members 12 and 14 or brace members 16, 18 and 20. When descending the tree, the climber's shoe is again placed inside the circular structural members 12 and 14 while grasping the structural member above for support. The climber can remove the tree steps 10 upon descent by removing the lag bolt 26 from the tree.

Conveniently, the step of the present invention can be made of any material. For example, any tastable or moldable plastic may be used to produce the step, such as a high-impact plastic, polystyrene, acrylonitrite butadiene styrene (ABS), polycarbonate (PC), or some combination of these materials in an integrated or alloy form. Any type of metal or plastic material that provides suitable strength and stability may be used to manufacture the step of the present invention.

The structural members 12 and 14 of the present invention are preferably about 166 mm in diameter. Alternatively, the diameter of the structural members 12 and 14 can range from about 125 mm to 230 mm in diameter. Likewise, the size of the aperture of each structural member may vary depending upon the configuration of the structural members.

While the structural members of the present invention are shown in a circular configuration, it will be appreciated by one skilled in the art that other configurations such as rectangular and polyhedral can be utilized. For example, a rectangular shaped tree climbing step may contain the features of the circular embodiment described above. However, it is possible that the rectangular shaped structure could be of a size large enough to receive both shoes of a climber simultaneously. This design would reduce the number of steps necessary to reach the desired height.

The brace members 16, 18 and 20 of the present invention are preferably about 115 mm in length and 13 mm in width. The brace members of the present invention can also vary in length, width and number. The preferred embodiment comprises three brace members; however, any number of brace members could be used. Preferably, the width of the brace members is between about 50 mm to 200 mm. It is also possible to have an infinite number of brace members such that the tree step resembles a hollow cylinder.

Naturally, there are many conceivable ways to fasten the step other than the lag bolt fasteners discussed above. For example, a fastener can include a strap and a buckle at one end. This type of fastener (i.e., the strap and buckle) can thus fasten the step to a tree or vertical surface without penetrating the surface. This type of fastener would be useful in national forests and other public lands which have strict rules and regulations against using steps that damage trees. Further, this type of fastener may be used in situations where the vertical surface is a metal utility pole or some other surface that cannot easily be penetrated by a screw. Moreover, the strap and buckle fastener allows for quick removability of the step without requiring an additional fastening tool. Alternative fastening devices are known in the art that can be utilized to secure the tree step 10 of the present invention to a tree, such as wood screws, nails, hooks, or rope.

In an alternative configuration, the tree step has a coupler with a "keyhole" configuration. The lower portion of the keyhole is larger than the head of a bolt such that a bolt that is already screwed into a tree may be received by the lower portion of the keyhole. Next, the coupler is slid downward so that the head of the lag bolt is restrained by the narrower upper portion. When the climber wishes to remove the step from the tree, the step can be slid upward to align the larger diameter lower portion with the head of the lag bolt. As described above, the diameter of the lower portion must be larger than the diameter of the head of the lag bolt, while the head of the lag bolt must have a larger diameter than the diameter of the upper portion. This configuration allows for the removal of the step without having to remove the lag bolt from the tree.

Additional support can be provided by use of cleats attached to the rear surface 38 of the second structural member 14. The cleat is a wedged shaped structure protruding from the second circular member which provides support and additional hold against the tree. Preferably, at least two cleats are attached to the lower portion of the second structural member. The cleats are preferably placed on opposite sides of the lower rigid brace member 16 facing towards the tree. When the climber's shoe is received inside the circular structural members 12 and 14, the weight of the climber forces the cleats positioned around the bottom half of the second structural member 14 against the tree.

In another embodiment, the second structural member 14 can be shaped to conform to the shape of a tree. The second structural member 14 of the tree step 10 can have a slight curve or convex shape in order to more closely form to the shape of a tree.

All the disclosed embodiments are useful for the purpose of climbing any vertical surface including a tree, wooden utility pole, metal streetlight, bridge, metal pole, or the like.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A removable step for use in climbing a vertical surface, said step comprising:

first and second structural members, each having an opening configured and sized to receive a shoe of a user;

at least two rigid brace members extending between and affixed to said structural members to secure said structural members in spaced apart relationship; and a coupler rigidly affixed to and extending outwardly from one of said structural members for securing said structural member to said vertical surface such that said openings are approximately parallel to said vertical surface, wherein said first and second structural members are generally circular, wherein said at least two rigid brace members comprise three rigid brace members secured to the circumferences of said circular structural members and positioned at substantially equal spacing from each other around the circumferences of said circular structural members, said first structural member comprises a rear surface and said second structural member comprises a front surface facing said rear surface of said first structural member, and wherein said brace members extend from said rear surface of said first structural member to said front surface of said second structural member, wherein said coupler comprises a tab with an opening for receiving a fastening device, said second structural member comprises a rear surface configured to face said vertical surface, and wherein cleats extend from said rear surface of said second structural member for engaging said vertical surface, and said structural members and said brace members comprise textured surfaces.

2. The removable step of claim 1, wherein said circular structural members have substantially identical diameters.

3. The removable step of claim 1, wherein said circular structural members have a diameter range of about 76 mm to 220 mm.

4. The removable step of claim 1, wherein at least one of said brace members is located at the bottom of said structural members about 180 degrees from said coupler.

5. The removable step of claim 1, wherein said textured surface comprises rubber.

6. The removable step of claim 1, wherein said textured surface comprises polyurethane.

7. The removable step of claim 1, wherein said first structural member is coated with a fluorescent material to increase visibility during darkness.

* * * * *